US005961164A

United States Patent [19]

Gomi

[11] Patent Number: 5,961,164

[45] Date of Patent: Oct. 5, 1999

[54] LATCH DEVICE FOR AN AUTOMOTIVE DOOR

[75] Inventor: Yoshito Gomi, Yamanashi-ken, Japan

[73] Assignee: Mitsui Kinzoku Kogyo Kabushiki Kaisha, Tokyo, Japan

[21] Appl. No.: 09/079,191

[22] Filed: May 15, 1998

[30] Foreign Application Priority Data

May 16, 1997 [JP] Japan ..... 09-143063

[51] Int. Cl.[6] ..... E05C 3/06

[52] U.S. Cl. ..... 292/216; 292/DIG. 23; 292/DIG. 27

[58] Field of Search ..... 292/201, 216, 292/DIG. 23, 336, DIG. 12, DIG. 27, DIG. 62, DIG. 65

[56] References Cited

U.S. PATENT DOCUMENTS

| | | | |
|---|---|---|---|
| 3,781,045 | 12/1973 | Watermann | 292/216 |
| 3,905,627 | 9/1975 | Fujita | 292/216 |
| 4,203,621 | 5/1980 | Noel et al. | 292/216 |
| 4,634,156 | 1/1987 | Shimura et al. | 292/216 |
| 4,783,102 | 11/1988 | Bernard | 292/216 |
| 5,054,827 | 10/1991 | Konchan et al. | 292/216 |
| 5,277,461 | 1/1994 | Dzurko et al. | 292/216 |
| 5,288,115 | 2/1994 | Inoue et al. | 292/201 |
| 5,308,128 | 5/1994 | Portelli et al. | 292/216 |
| 5,785,366 | 7/1998 | Takaishi et al. | 292/341.12 |

FOREIGN PATENT DOCUMENTS 07-034742 2/1995 Japan .

*Primary Examiner*—Flemming Saether
*Assistant Examiner*—Clifford B. Vaterlaus
*Attorney, Agent, or Firm*—Browdy and Neimark

[57] ABSTRACT

An automotive door latch device comprises a latch rotatably mounted to a latch body by a latch shaft and engageable with a striker, a ratchet rotatably mounted to the body by a ratchet shaft and engageable with the latch, an opening mechanism for releasing the ratchet from the latch for opening the door, a lock lever switched between an unlocked position and a locked position, a block lever rotatably mounted to the latch body by a block shaft and engaging with the lock lever when the latch is in an unlatched position so as to prevent the lock lever from moving from the unlocked position to the locked position. The latch, the ratchet and the block lever are arranged on the same plane. The block lever and the ratchet are arranged along a lateral direction of the latch body.

17 Claims, 8 Drawing Sheets

LATCH DEVICE FOR AN AUTOMOTIVE DOOR

BACKGROUND OF THE INVENTION

1. Field of the Invention

The present invention relates to a latch device for an automotive door, and particularly relates to a latch device in which an automotive door cannot be locked when it is in a door-open position.

2. Description of the Related Arts

In a conventional automotive door latch device, a door can be simply and easily locked by switching the latch device of the door into a locked state by an locking operation of an inside locking button of the door even if the door is in an open position. Therefore, difficulty frequently occurs when the door is closed when the inside locking button is in a locked state and the door key is locked in the vehicle cabin.

Further, in order to reduce this problem, prior art devices have been introduced such as an automotive door latch device which requires an additional entry operation such as an opening operation of a door open handle. This latch device comprises, as shown in FIG. 11, a latch B displaceable from an unlatched position to a full-latched position by engaging with a striker A, a ratchet C for holding an engagement between the latch B and the striker A by engaging with the latch B, an open lever D connected to an open handle of a door, an open link G having an engagement surface F which engages with a ratchet pin E of the ratchet C when the open lever D rotates so as to disengage the ratchet C from the latch B, and a lock lever H connected to a key cylinder and an inside lock button of the door and switched between an unlocked position for enabling an opening operation of the open link G and a locked position for disabling the opening operation of the open link G. The ratchet pin E is displaceable between a door-closed position shown by a solid line in which the the ratchet C is engaged with the latch B and an door-open position shown by a dot line in which the ratchet C is disengaged from the latch B. The open link G has a projection J which is engageable with the ratchet pin E at the door-open position but is disengageable with the ratchet pin E at the door-closed position.

In the full-latched or door-closed state shown in FIG. 11, since the projection J is disengageable with the ratchet pin E shown by the solid line, the lock lever H can be rotated clockwise by a locking operation of the inside lock button so as to move the open link G leftward, thereby the latch device can be switched to a locked state in which the engagement surface F is disengageable with the ratchet pin E.

In the unlatched or door-open state, the ratchet pin E is displaced to the door-open position shown by the dot line, and precludes the open link G from moving leftward by engaging with the projection J, thereby the lock lever H cannot be rotated clockwise and the latch device is held in the unlocked state. A facing between the pin E and the projection J can be cancelled by the opening operation of the open handle as an entry operation. The opening operation moves the open link G downward so as to make the projection J move apart from the ratchet pin E shown by the dot line, thereby the lock lever H can be rotated clockwise even when the door is in the open position.

As mentioned above, the conventional latch device shown in FIG. 11 prevents the latch device from being erroneously switched to the locked state by requiring the entry operation. However, when the same automotive vehicle is used for a long time, the driver unconsciously performs the entry operation, so that the problem mentioned above occurs.

In addition to the prior art device of FIG. 11, the applicant or the assignee of the present invention suggests, in Japanese Patent Application Laid-Open No. 7-34742, a latch device in which an automotive door cannot be locked when it is in a door-open position. As shown in FIG. 12, this latch device is substantially constituted by the same construction as that of the conventional latch device mentioned above and further comprises a sub projection K formed at a lower end of the open link G and an immovable blocker L formed in the latch body. In this latch device, when the open link G is moved downward by the entry operation, the sub projection K becomes engageable with the blocker L before the main projection J is apart from the ratchet pin E. Accordingly, even when the entry operation is performed, the clockwise rotation of the lock lever H is precluded by an engagement between the sub projection K and the blocker L, so that the latch device cannot be switched to the locked state.

The latch device shown in FIG. 12 is structured simply but a cost for manufacturing the same is unexpectedly high. Because, in the latter device, switching the lock lever H to the locked position is precluded by utilizing two engagements such as the engagement between the main projection J and the ratchet pin E and the engagement between the sub projection K and the blocker L, so that a high accuracy is required for manufacturing the parts, particularly the open lever D and the open link G. Further, a high accuracy is required for mounting a rod used for connecting the open lever D to the open handle.

There is another prior art latch device, as shown in FIGS. 13 and 14, in which an automotive door cannot be locked when it is in a door-open position. This latch device comprises a latch B rotatably mounted to a latch shaft M and engageable with a striker A fixed to a vehicle body, a ratchet C rotatably mounted to a ratchet shaft N and engageable with the latch B, an open lever D connected to an open handle of the door, an open link G releasing the ratchet C from the latch B by engaging with the ratchet C when the open lever D is rotated, a lock lever H connected to a key cylinder and an inside lock button of the door and switched between an unlocked position for enabling an opening operation of the open link G and a locked position for disabling the opening operation of the open link G, a cam member P fixed to the latch B, and a block lever S rotatably mounted to a block shaft R.

In this latch device, when the latch B is in the unlatched position, the block lever S is pushed by the cam member P, and a front end T of the block lever S is then moved into a space formed below a tip end U of the lock lever H as shown in dot line, thereby a locking rotation of the lock lever H in a clockwise direction in FIG. 14 is precluded.

In this latch device, when the block lever S is used, a high accuracy with respect to the various kinds of parts is not required and a freedom in designing the latch device is increased. However, the latch device has some disadvantages. A first problem is that the number of the parts is increased since the cam body P is used for transmitting the rotational movement of the latch B to the block lever S. A second problem is that a longitudinal length of the latch device is increased since the block lever S is disposed on an opposite side of the ratchet C on the basis of the latch B.

A third problem is that the block lever S can easily block the lock lever H supported by a shaft X perpendicular to the latch shaft M, but cannot easily block the lock lever supported by a shaft parallel to the latch shaft M. When the lock lever is supported by the shaft X perpendicular to the latch shaft M, the lock lever may be accessed by a gripping tool inserted into a gap between a window glass and the door frame with a high possibility, so that it is desirable that the lock lever is supported by the shaft parallel to the latch shaft M. A fourth problem is that three parts, i.e. the latch B, the cam member P and the block lever S are overlapped in the axial direction of the latch shaft M, as shown in FIG. 14. Due to this overlapping, a thickness, on a straight line connecting the latch shaft M and the ratchet shaft N, of the latch device becomes thick. Since the straight line substantially coincides with a moving locus of the window glass of the door, the thickness of the latch device makes design of the window glass difficult.

SUMMARY OF THE INVENTION

Accordingly, an object of the present invention is to provide an automotive door latch device which overcomes deficiencies in the prior art device noted above.

Further, another object of the present invention is to provide a door latch device in which a latch, a ratchet and a block lever are substantially arranged on the same plane, thereby reducing a thickness of the latch device in an axial direction of a latch shaft.

Still further, another object of the present invention is to provide a door latch device in which a ratchet and a block lever are arranged substantially in a lateral direction of a latch body, thereby reducing a longitudinal length of the latch device without substantially increasing a lateral length of the device.

DESCRIPTION OF THE PREFERRED EMBODIMENTS

Figure 1:
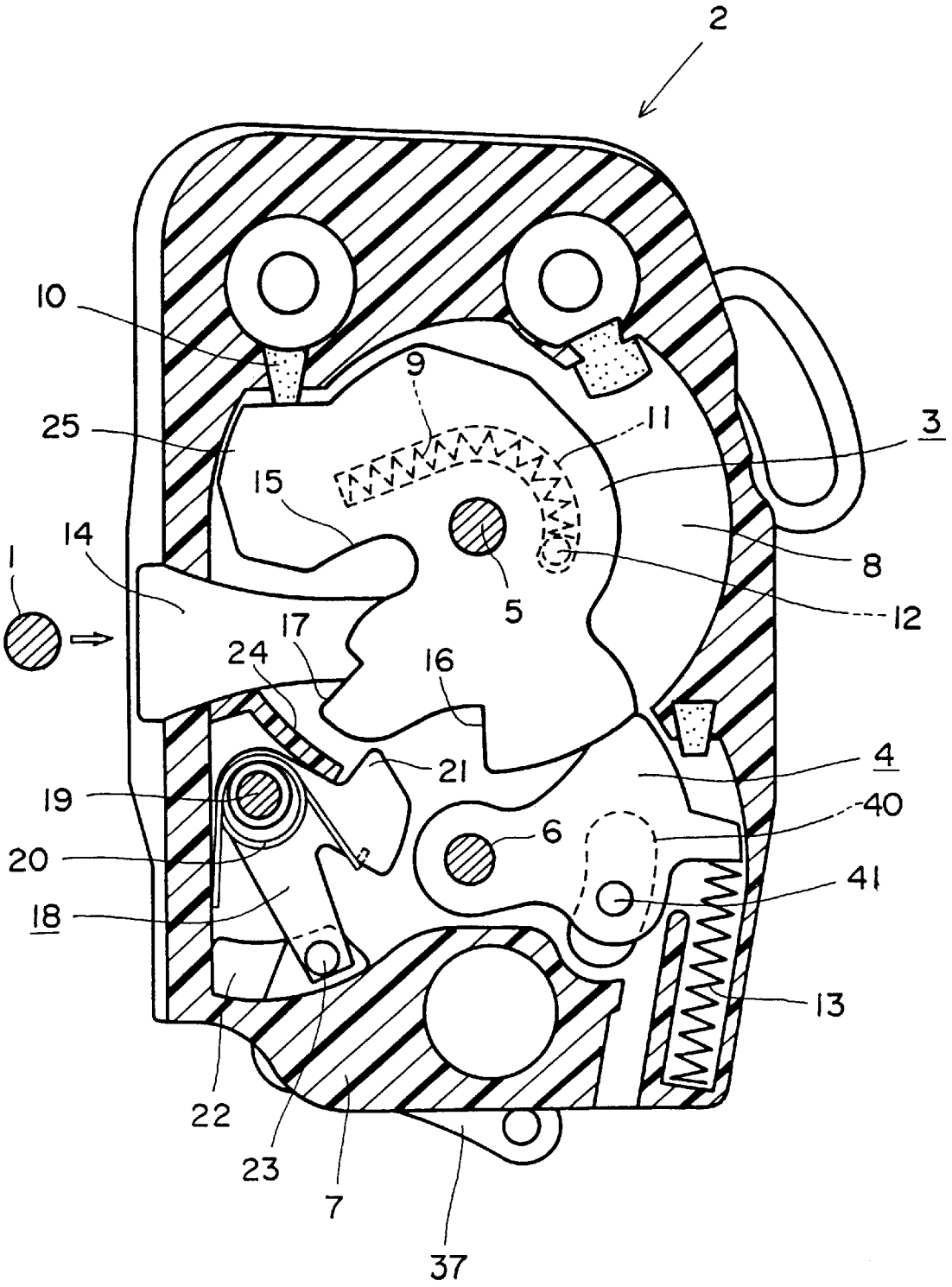
FIG. 1 is a vertically sectional front view of a latch device in accordance with the present invention in a door-open state.

An embodiment of the present invention will now be described below with reference to the drawings. An automotive door latch device in accordance with the present invention is constituted by a striker 1 fixed to a vehicle body (not shown) and a latch assembly 2 fixed to a door (not shown). The latch assembly 2 has a latch 3 adapted to be engaged with the striker 1 when the door is closed and a ratchet 4 for keeping the engagement between the latch 3 and the striker 1. The latch 3 and the ratchet 4 are rotatably received within a recess 8 formed on a front surface of a synthetic resin latch body 7 by means of a latch shaft 5 and a ratchet shaft 6, respectively.

Figure 2:
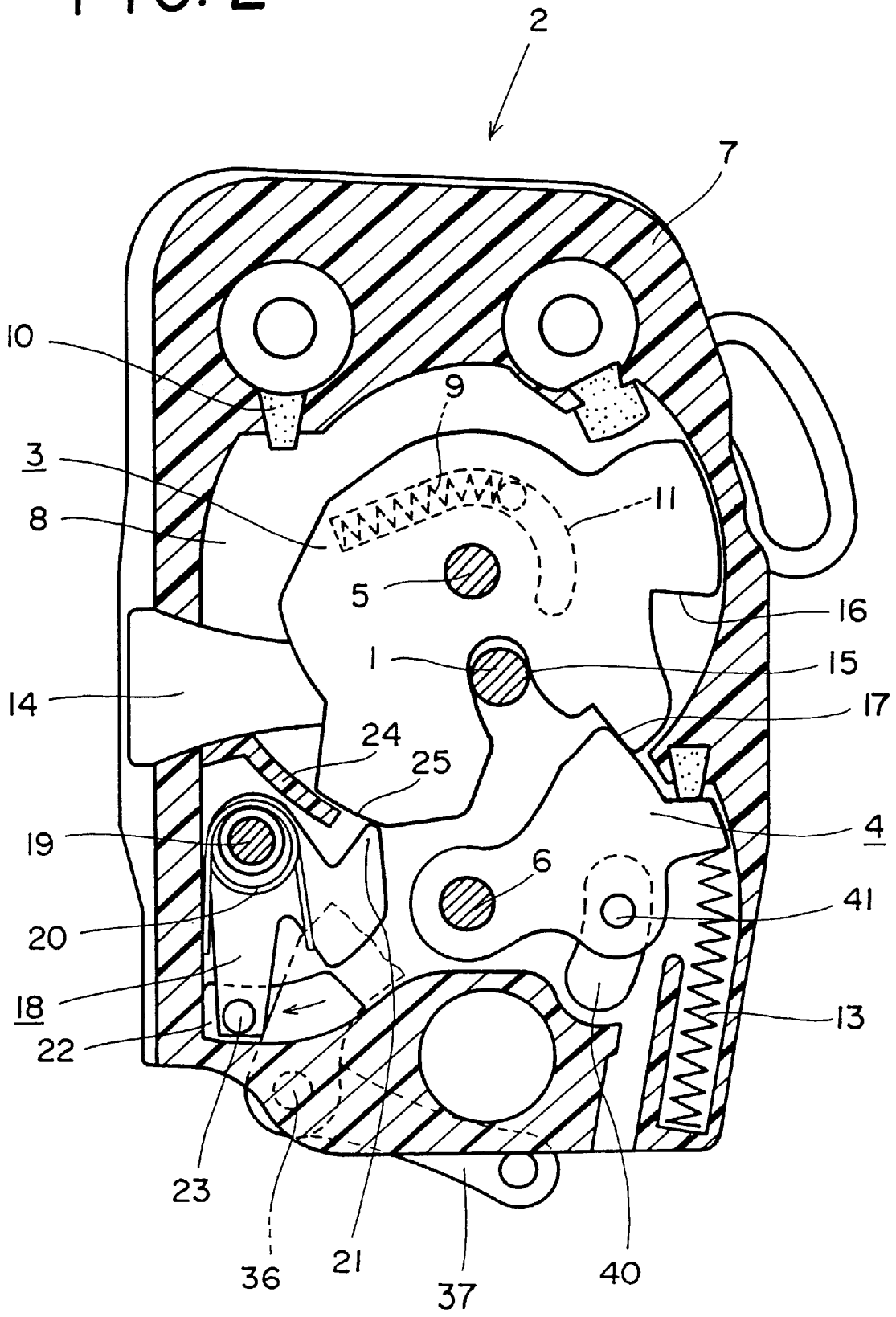
FIG. 2 is a vertically sectional front view of the latch device in a door-closed state.

The latch 3 is urged clockwise in FIG. 1 by means of the resilient force of a spring 9, and is brought into contact with a damping member 10 fixed to the latch body 7 when the door is in an open position (an unlatched position). The spring 9 is housed within a groove 11 formed in the latch body 7, and presses a projection 12 of the latch 3. The ratchet 4 is urged counterclockwise in FIG. 1 by means of the resilient force of a spring 13, and is brought into contact with the latch 3. When the door moves toward a closed position from the open position, the striker 1 enters into a horizontal passage 14 formed in the latch body 7, and then comes into contact with a U-shaped groove 15 of the latch 3, thereby the latch 3 is rotated counterclockwise against the resilient force of the spring 9. When the latch 3 is turned from an unlatched position shown in FIG. 1 to a half-latched position, the ratchet 4 is engaged with a first step 16 of the latch 3 by the resilient force of the spring 13, and when the latch 3 comes to a full-latched position shown in FIG. 2, the ratchet 4 is engaged with a second step 17 of the latch 3, thereby the door is kept in the closed position. The latch 3 and the ratchet 4 are arranged on the same plane, and a straight line connecting between the latch shaft 5 and the ratchet shaft 6 is arranged in such a manner as to cross the horizontal passage 14 substantially in a perpendicular direction.

Figure 3:
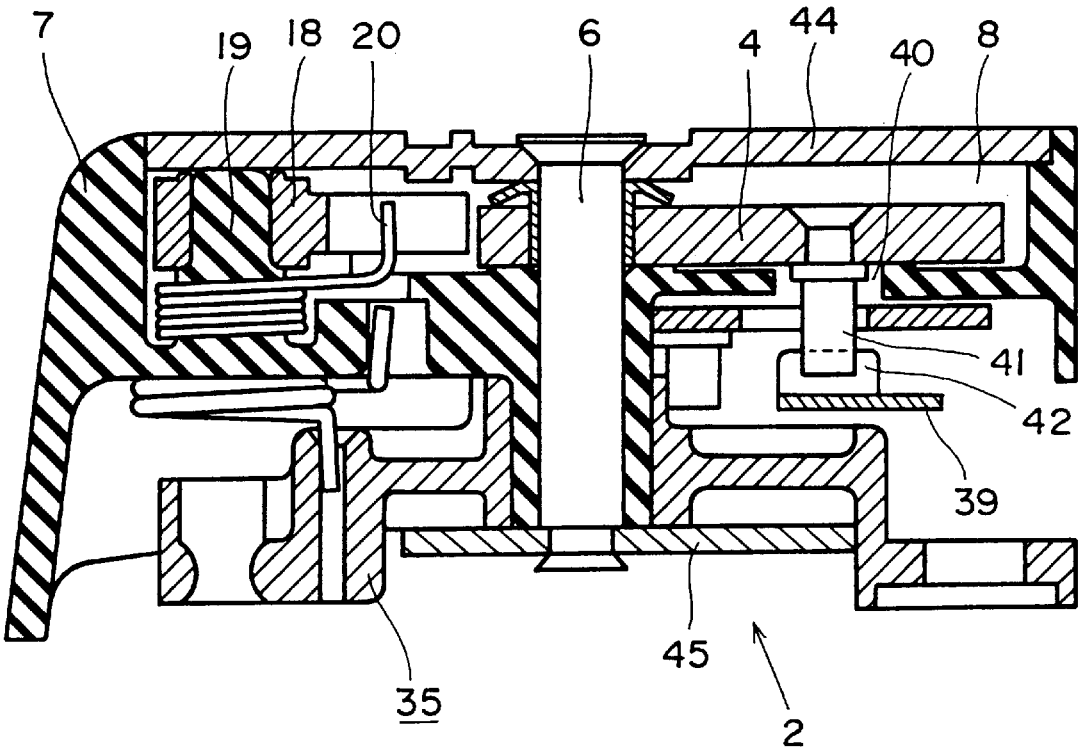
FIG. 3 is a horizontally sectional plan view of the latch device.

A block lever 18 is rotatably housed within the recess 8 by a block shaft 19 so that the block lever 18 is provided in the vicinity of the ratchet 4. The block lever 18 is substantially formed into an inverted V-shape, and is arranged on a plane which is substantially the same as the latch 3 and the ratchet 4. The block shaft 19 can be integrally formed with the latch body 7 as shown in FIG. 3. A straight line connecting the block shaft 19 and the ratchet shaft 6 is arranged in such a manner as to be substantially in parallel to the horizontal passage 14 which extends in a lateral direction of the latch body 7. The block lever 18 is urged counterclockwise by a resilient force of a spring 20, and has a nose portion 21 which substantially extends toward the latch shaft 5 and a block pin 23 which projects to a rear side of the latch body 7 through a hole 22 formed in the body 7.

Figure 9:
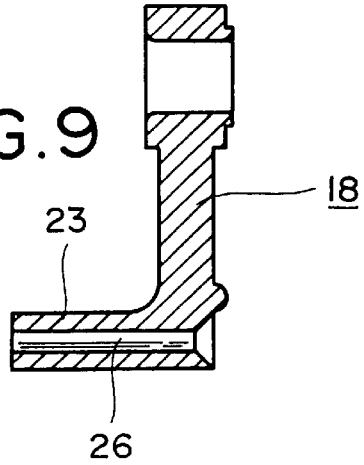
FIG. 9 is a sectional view of the block lever.
Figure 10:
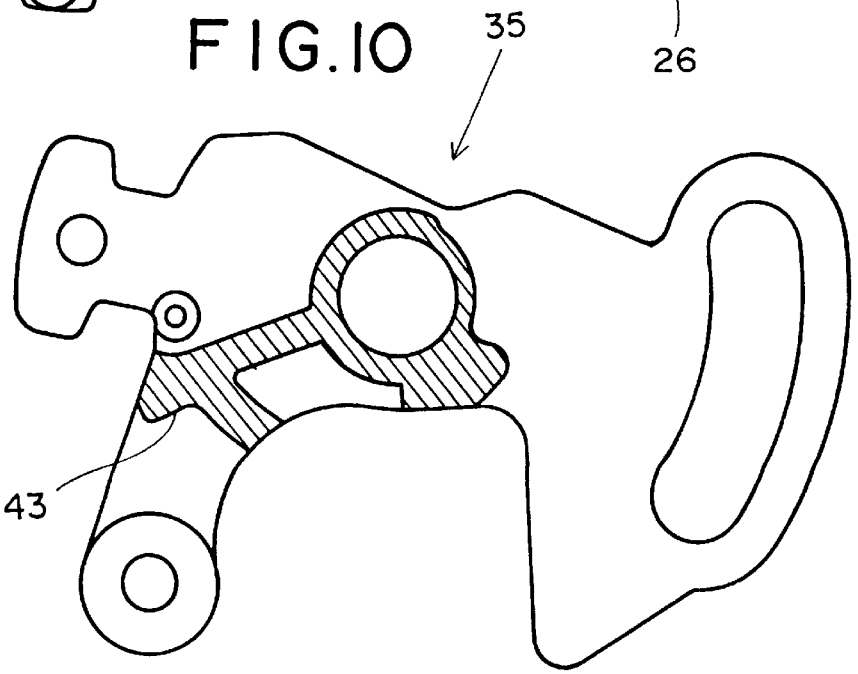
FIG. 10 is an enlarged front view of a lock lever of the latch device.
Figure 11:
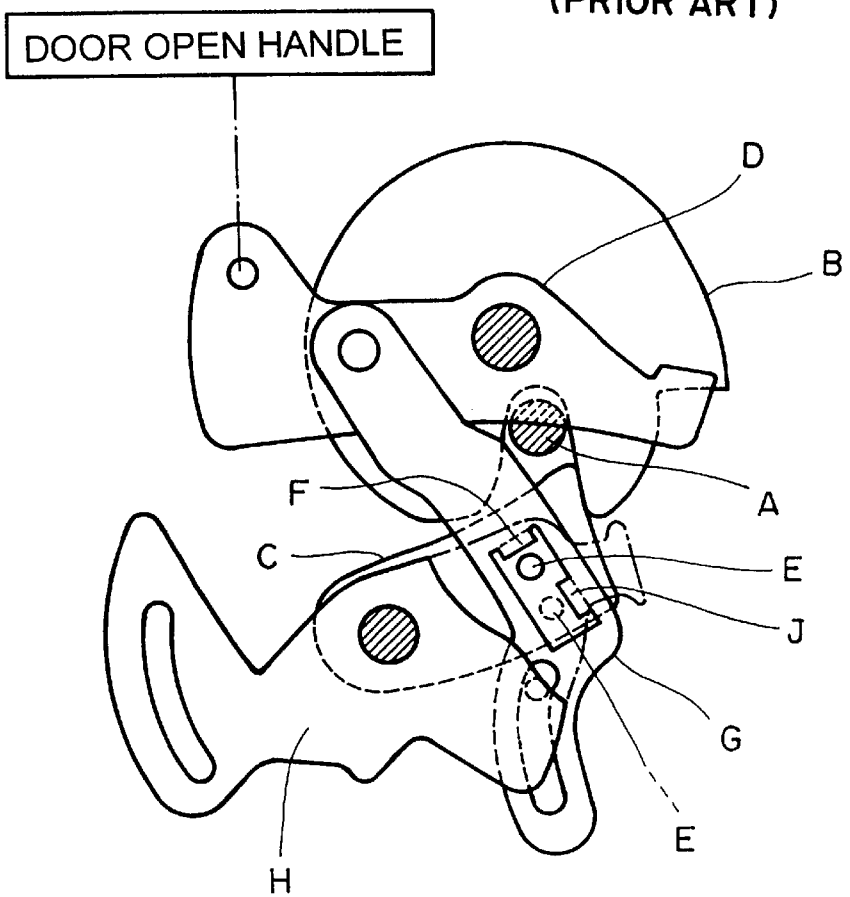
FIG. 11 (PRIOR ART)
FIGS. 11 to 14 are schematic views which show a conventional latch devices.
Figure 12:
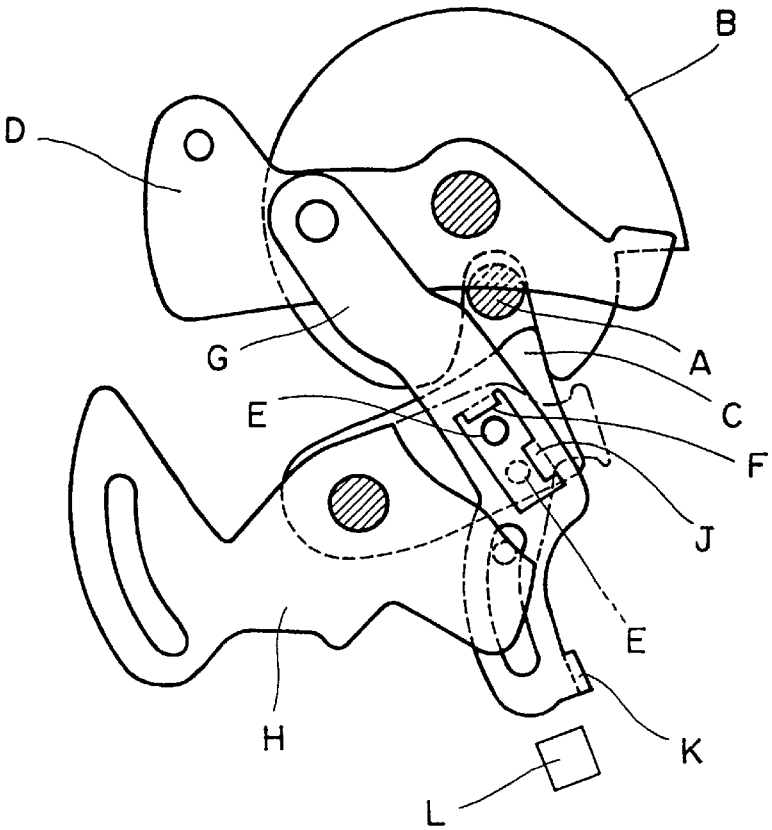
FIG. 12 (PRIOR ART)
Figure 13:
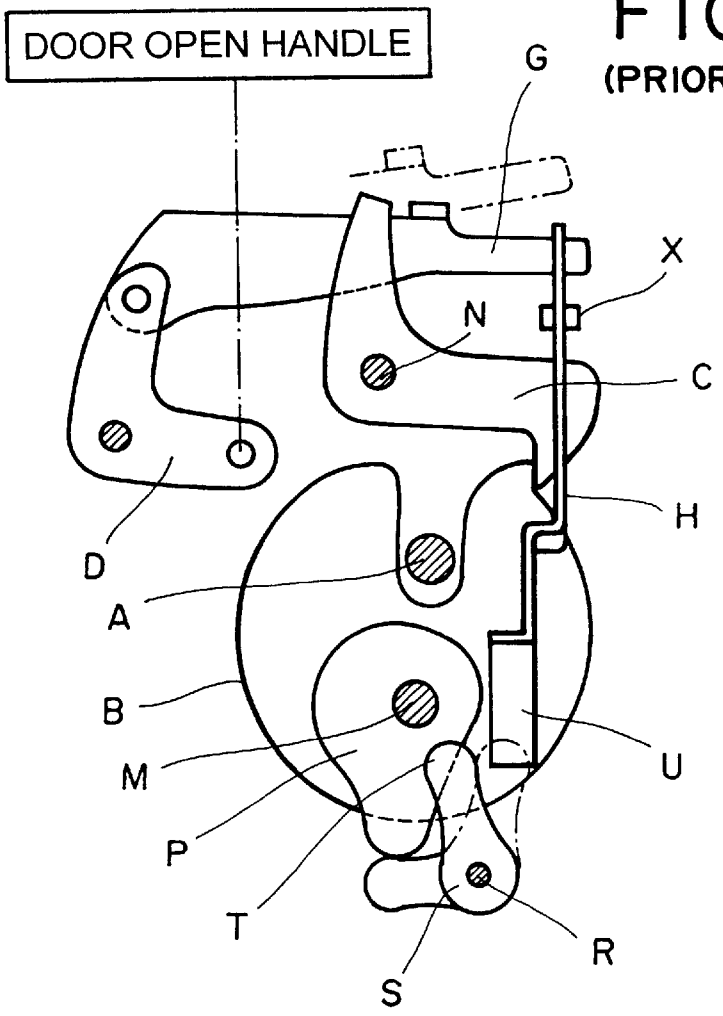
FIG. 13 (PRIOR ART)
Figure 14:
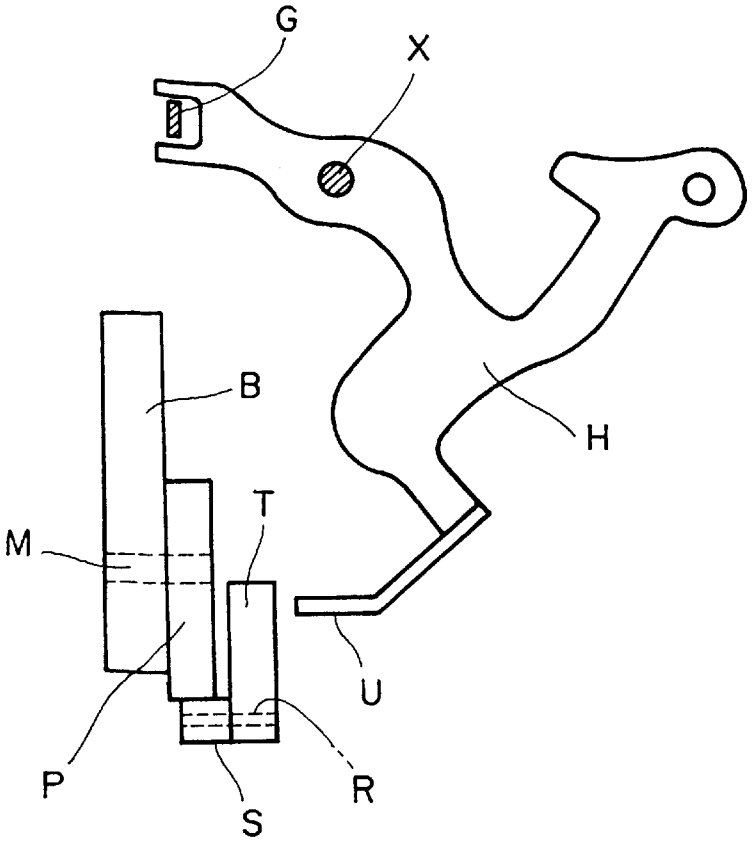
FIG. 14 (PRIOR ART)

When the latch 3 is in the unlatched position (or the half-latched position) as shown in FIG. 1, the block lever 18 is in contact with a wall 24 formed in the latch body 7 by the resilient force of the spring 20 and is held at a blocking position shown in FIG. 1, in which the nose portion 21 is apart from the latch 3. However, when the latch 3 is rotated from the half-latched position toward the full-latched position, a cam surface 25 formed on an outer peripheral surface of the latch 3 comes into contact with the nose portion 21 and causes the block lever 18 to be gradually rotated clockwise against the resilient force of the spring 20, thereby the block lever 18 is displaced into an unblocking position shown in FIG. 2 upon completion of the full-latched position of the latch 3. The cam surface 25 is provided on one side of the latch 3 on the basis of the U-shaped groove 15, and the steps 16, 17 are provided on the other side of the latch 3. When the block lever 18 is made of a synthetic resin, it is desirable to install a reinforcing metal pin 26 within the block pin 23 as shown in FIG. 9.

Figure 4:
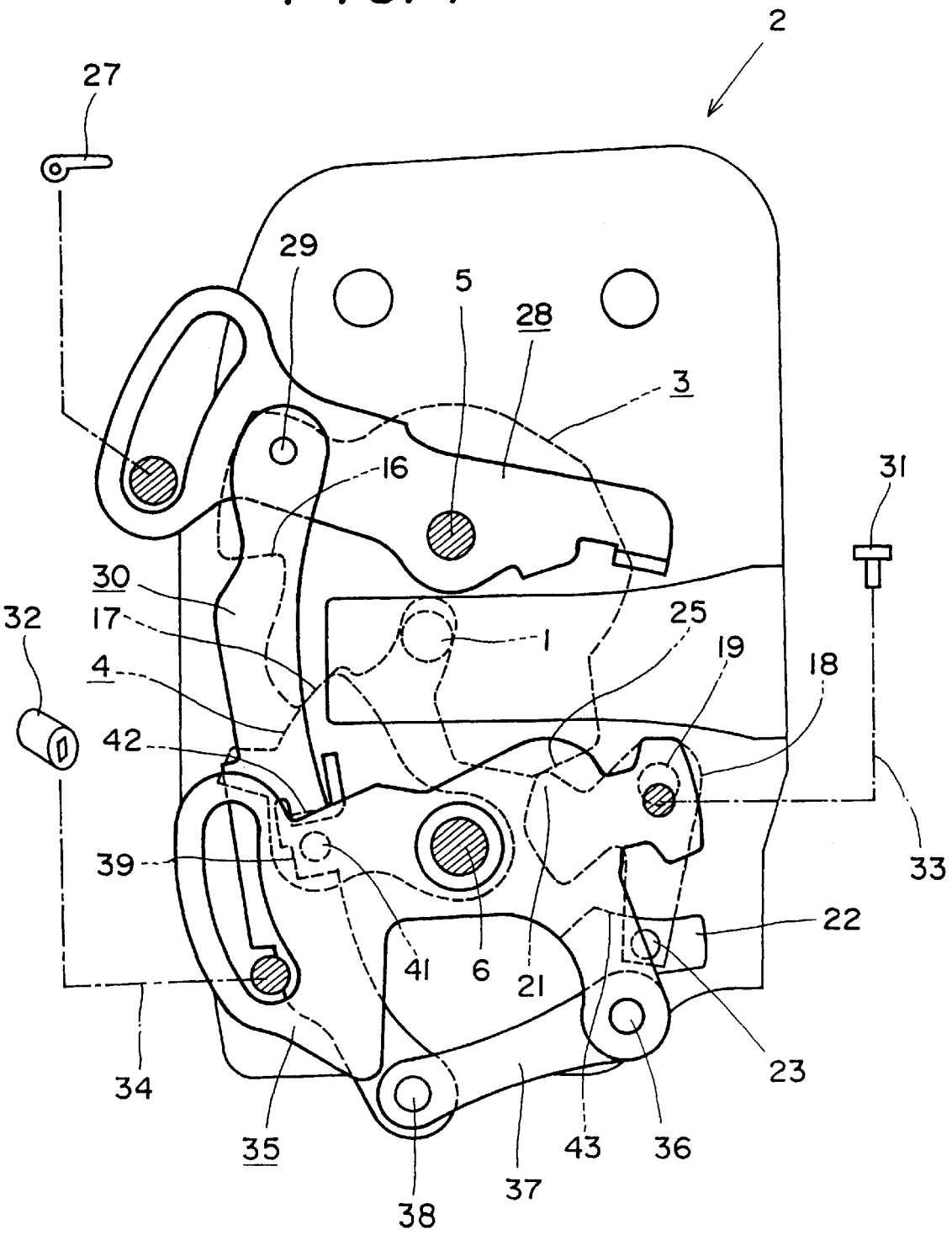
FIG. 4 is a rear elevational view of the latch device in the door-closed and an unlocked state.
Figure 5:
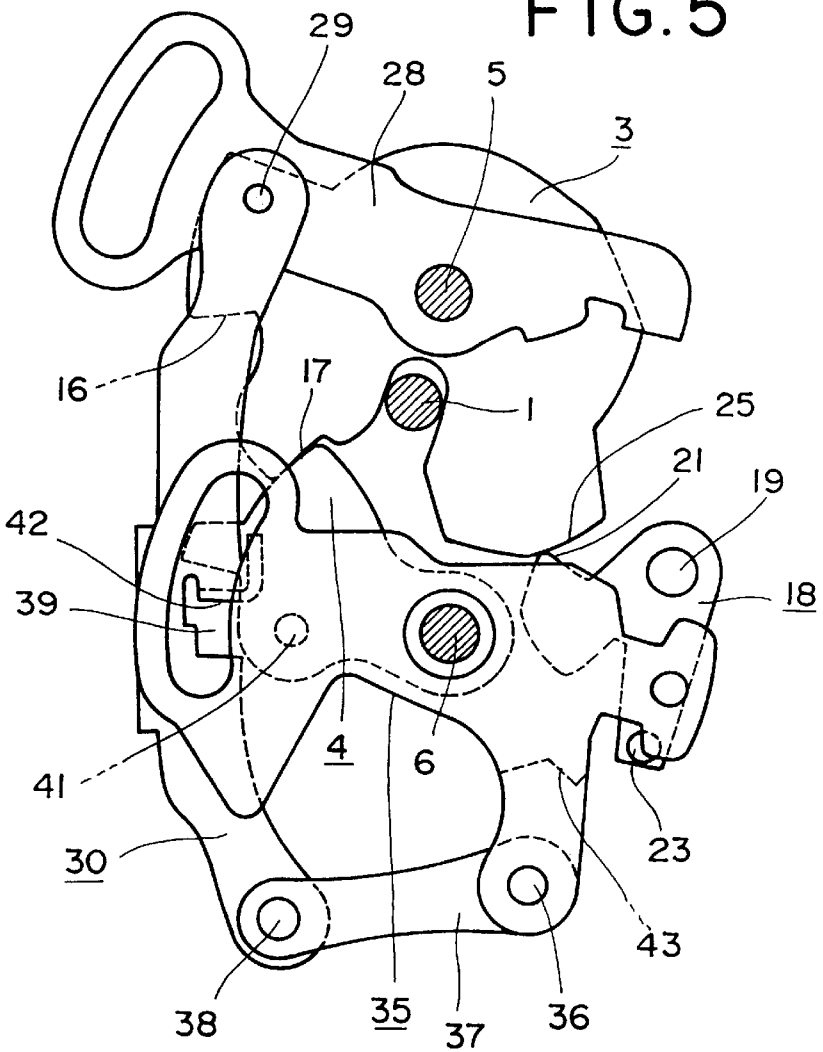
FIG. 5 is a rear elevational view of the latch device in the door-closed and a locked state.
Figure 6:
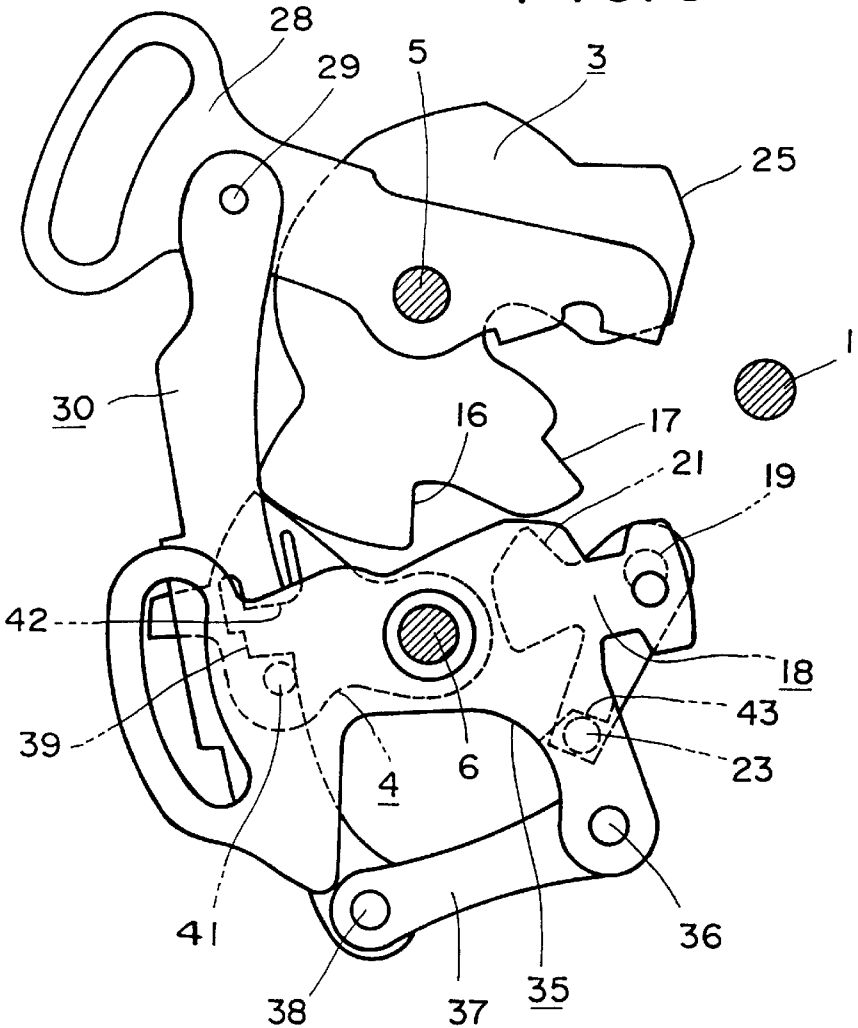
FIG. 6 is a rear elevational view of the latch device in the door-open and the unlocked state.
Figure 7:
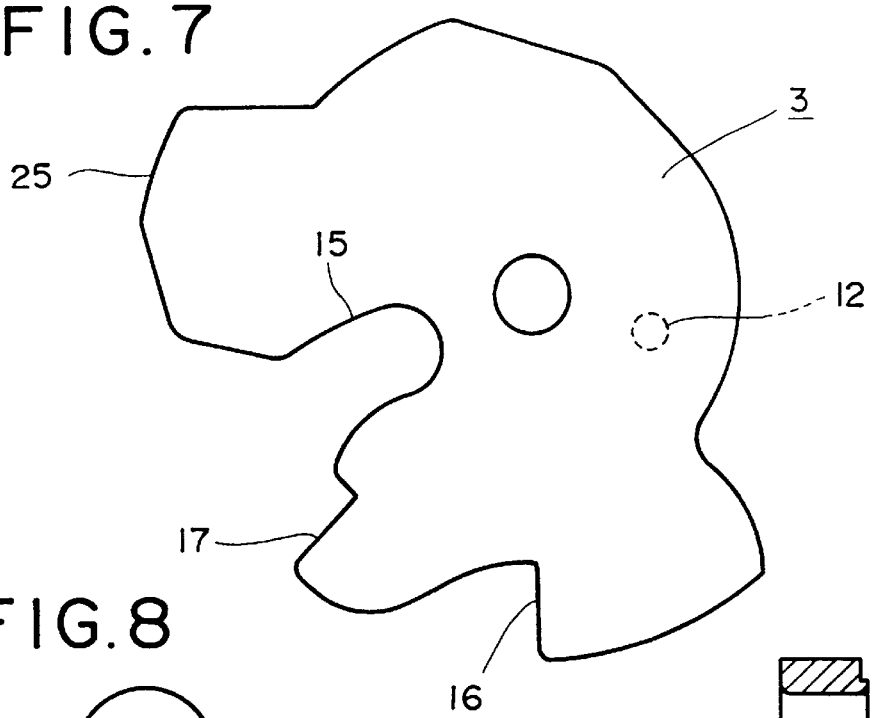
FIG. 7 is an enlarged front view of a latch of the latch device.
Figure 8:
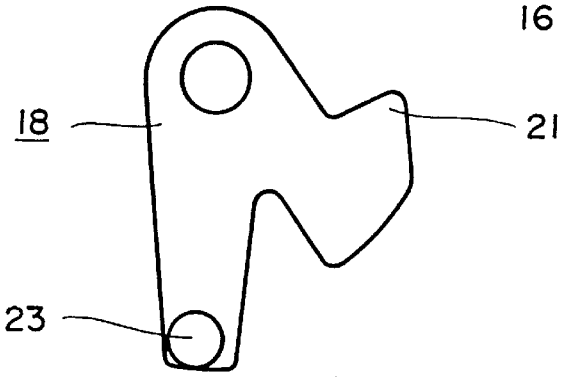
FIG. 8 is a front view of a block lever of the latch device.

As shown in FIGS. 4 to 6, in the rear side of the latch body 7, an open lever 28 which is connected to a door open handle 27 of the door is rotatably supported on the latch shaft 5. An open link 30 is connected to the open lever 28 by a pin 29. Further, in the rear side of the latch body 7, a lock lever 35 which is connected to an inside lock button 31 and a key cylinder 32 of the door through rods 33 and 34, is rotatably supported on the ratchet shaft 6. One end of an intermediate link 37 is connected to the lock lever 35 by a pin 36, and the other end of the intermediate link 37 is connected to a lower end of the open link 30 by a pin 38. The lock lever 35 is displaced between an unlocked position shown in FIG. 4 and a locked position shown in FIG. 5 by an operation of the inside lock button 31 and the like. A notch portion 39 is formed in a middle portion of the open link 30. At an edge portion of the notch portion 39 is formed a bent portion 42 which is engageable with a ratchet pin 41 projecting to the rear side of the latch body 7 from the ratchet 4 through a hole 40 of the body 7.

FIGS. 4 and 5 show a full-latched or door-closed state of the latch device in which the ratchet 4 is engaged with the second step 17 of the latch 3. As shown in FIG. 4 the bent portion 42 of the open link 30 is engageably opposed to the ratchet pin 41 when the lock lever 35 is in the unlocked position under the full-latched state. Thus, when the open link 30 is caused to be moved downward by rotating the open lever 28 by means of the open handle 27, the bent portion 42 is brought into contact with the ratchet pin 41 to rotate the ratchet 4 against the resilient force of the spring 13, thereby the ratchet 4 is disengaged from the second step 17 of the latch 3 and the latch 3 is returned to the unlatched position as shown in FIG. 6 so as to open the door.

As shown in FIG. 5, the open link 30 is substantially shifted to a leftward direction when the lock lever 35 is changed into the locked position under the full-latched state, thereby the bent portion 42 becomes disengageable with the ratchet pin 41. Accordingly, the downward movement of the open link 30 cannot rotate the ratchet 4, so that the door cannot be opened.

As described above, when the latch 3 is returned to the unlatched position by opening the door, the nose portion 21 of the block lever 18 is released from the cam surface 25 of the latch 3, thereby the block lever 18 is returned to the blocking position by the resilient force of the spring 20 as shown in FIG. 6. At the blocking position, the block pin 23 of the block lever 18 is engageably opposed to an engagement surface 43 formed on the lower surface of the lock lever 35 in order to preclude the lock lever 35 from being rotated clockwise toward the locked position. Accordingly, when the door is in the open state, it becomes impossible to switch the lock lever 35 into the locked position. When closing the door, the block lever 18 is shifted to the unblocking position, and the block pin 23 is then apart from the engagement surface 43, thereby enabling the clockwise rotation of the lock lever 35 toward the locked position.

In FIG. 3, a metal cover plate 44 for substantially covering the recess 8 of the latch body 7 is mounted to the front side of the latch body 7, and a metal back plate 45 is mounted to the rear side of the latch body 7.

Advantages

In the latch device in accordance with the present invention, when the latch 3 is in the unlatched position, the block pin 23 of the block lever 18 is engageably opposed to the lock lever 35 in order to preclude the lock lever 35 from being displaced into the locked position, so that the problem of closing the door when in a locked state and locking the door key within the vehicle cabin is be prevented.

Further, since the latch 3, the ratchet 4 and the block lever 18 are substantially arranged on the same plane, the thickness of the latch device in the axial direction of the latch shaft 5 can be made thin.

Further, since the block lever 18 is provided in the vicinity of the ratchet 4, the longitudinal length of the latch device can be reduced without substantially increasing the lateral length of the latch device.

Still further, since the step 17 for engaging with the ratchet 4 is provided on one side of the latch 3 on the basis of the U-shaped groove 15 and the cam surface 25 for coming into contact with the block lever 18 on the other side of the latch 3, the block lever 18 can be easily provided in the vicinity of the ratchet 4.

Furthermore, since the latch 3, the ratchet 4 and the block lever 18 are arranged in the front side of the latch body 7, the lock lever 35 is arranged in the rear side of the latch body 7, and the block lever 18 has the block pin 23 which is engageable with the lock lever 35 by projecting to the rear side of the latch body 7, the connection relation between the block lever 18 and the lock lever 35 can be easily secured.

Moreover, since the block lever 18 is not connected to the ratchet 4, a smooth motion of the ratchet 4 can be secured.

What is claimed is:

1. An automotive door latch device comprising:

a latch body adapted to be fixed to an automotive door;

a striker adapted to be fixed to an automotive body;

a latch rotatably mounted to the latch body by means of a latch shaft and displaceable from an unlatched position to a full-latched position by engaging with the striker when the door moves toward a door-closed position from a door-open position;

a ratchet rotatably mounted to the latch body by means of a ratchet shaft parallel to the latch shaft and engageable with the latch for holding an engagement between the latch and the striker;

said latch and said ratchet being substantially aligned along a longitudinal length of the latch body;

an opening mechanism adapted to be connected to an open handle of the door and releasing the ratchet from the latch for opening the door when the open handle is operated;

a lock lever adapted to be connected to a key cylinder and an inside lock button of the door and switched between an unlocked position for enabling an opening operation of the opening mechanism and a locked position for disabling the opening operation of the opening mechanism; and a block lever rotatably mounted to the latch body by means of a block shaft, said block lever being rotated by a direct contact with the latch and engaging with the lock lever when the latch is displaced into the unlatched position from the latched position so as to prevent the lock lever from moving from the unlocked position to the locked position;

wherein said latch, said ratchet and said block lever are substantially arranged on the same plane.

2. An automotive door latch device according to claim 1, wherein said block lever and said ratchet are substantially aligned along a lateral width of the latch body perpendicular to the longitudinal length.

3. An automotive door latch device according to claim 2, wherein said latch has a U-shaped groove with which the striker is engaged when the door is closed, a step for engaging with the ratchet, and a cam surface for coming into contact with the block lever; wherein said step is provided on a first side of the latch on the basis of the U-shaped groove, and said cam surface is provided on a second side of the latch on the basis of the U-shaped groove.

4. An automotive door latch device according to claim 1, wherein said latch has a U-shaped groove with which the striker is engaged when the door is closed, a step for engaging with the ratchet, and a cam surface for coming into contact with the block lever; wherein said step is provided on a first side of the latch on the basis of the U-shaped groove, and said cam surface is provided on a second side of the latch on the basis of the U-shaped groove.

5. An automotive door latch device according to claim 1, wherein said latch, said ratchet and said block lever are arranged in a front side of the latch body, said lock lever is arranged in a rear side of the latch body, and said block lever has a block pin which projects to the rear side of the latch body and is engageable with the lock lever.

6. An automotive door latch according to claim 1, wherein a straight line connecting said ratchet shaft and said latch shaft is arranged in such a manner as to be substantially in perpendicular to a horizontal passage for receiving the striker when the door moves toward the door-closed position from the door-open position.

7. An automotive door latch device according to claim 1, wherein said latch, said ratchet and said block lever are arranged in such a manner as not to substantially overlap with each other.

8. An automotive door latch device comprising:

a latch body adapted to be fixed to an automotive door;

a striker adapted to be fixed to an automotive body;

a latch rotatably mounted to the latch body by means of a latch shaft and displaceable from an unlatched position to a full-latched position by engaging with the striker when the door moves toward a door-closed position from a door-open position;

a ratchet rotatably mounted to the latch body by means of a ratchet shaft parallel to the latch shaft and engageable with the latch for holding an engagement between the latch and the striker;

said latch and said ratchet being substantially aligned along a longitudinal length of the latch body;

an opening mechanism adapted to be connected to an open handle of the door and releasing the ratchet from the latch for opening the door when the open handle is operated;

a lock lever adapted to be connected to a key cylinder and an inside lock button of the door and switched between an unlocked position for enabling an opening operation of the opening mechanism and a locked position for disabling the opening operation of the opening mechanism; and a block lever rotatably mounted to the latch body by means of a block shaft, said block lever being rotated by a direct contact with the latch and engaging with the lock lever when the latch is displaced into the unlatched position from the latched position so as to prevent the lock lever from moving from the unlocked position to the locked position;

wherein said latch, said ratchet and said block lever are substantially arranged on the same plane;

wherein said block lever and said ratchet are substantially aligned along a lateral width of the latch body perpendicular to the longitudinal length;

wherein said latch has a U-shaped groove with which the striker is engaged when the door is closed, a step for engaging with the ratchet, and a cam surface for coming into contact with the block lever; wherein said step is provided on a first side of the latch on the basis of the U-shaped groove, and said cam surface is provided on a second side of the latch on the basis of the U-shaped groove.

9. An automotive door latch device according to claim 8, wherein said block lever and said ratchet are substantially aligned along a lateral width of the latch body perpendicular to the longitudinal length.

10. An automotive door latch device according to claim 8, wherein said latch, said ratchet and said block lever are arranged in a front side of the latch body, said lock lever is arranged in a rear side of the latch body, and said block lever has a block pin which projects to the rear side of the latch body and is engageable with the lock lever.

11. An automotive door latch according to claim 8, wherein a straight line connecting said ratchet shaft and said latch shaft is arranged in such a manner as to be substantially in perpendicular to a horizontal passage for receiving the striker when the door moves toward the door-closed position from the door-open position.

12. An automotive door latch device according to claim 8, wherein said latch, said ratchet and said block lever are arranged in such a manner as not to substantially overlap with each other.

13. An automotive door latch device comprising:

a latch body adapted to be fixed to an automotive door;

a striker adapted to be fixed to an automotive body;

a latch rotatably mounted to the latch body by means of a latch shaft and displaceable from an unlatched position to a full-latched position by engaging with the striker when the door moves toward a door-closed position from a door-open position;

a ratchet rotatably mounted to the latch body by means of a ratchet shaft parallel to the latch shaft and engageable with the latch for holding an engagement between the latch and the striker;

said latch and said ratchet being substantially aligned along a longitudinal length of the latch body;

an opening mechanism adapted to be connected to an open handle of the door and releasing the ratchet from the latch for opening the door when the open handle is operated;

a lock lever adapted to be connected to a key cylinder and an inside lock button of the door and switched between an un locked position for enabling an opening operation of the opening mechanism and a locked position for disabling the opening operation of the opening mechanism; and a block lever rotatably mounted to the latch body by means of a block shaft, said block lever being rotated by a direct contact with the latch and engaging with the lock lever when the latch is displaced into the unlatched position from the latched position so as to prevent the lock lever from moving from the unlocked position to the locked position;

wherein said latch, said ratchet and said block lever are substantially arranged on the same plane;

wherein said latch has a U-shaped groove with which the striker is engaged when the door is closed, a step for engaging with the ratchet, and a cam surface for coming into contact with the block lever; wherein said step is provided on a first side of the latch on the basis of the U-shaped groove, and said cam surface is provided on a second side of the latch on the basis of the U-shaped groove.

14. An automotive door latch device according to claim 13, wherein said block lever and said ratchet are substantially aligned along a lateral width of the latch body perpendicular to the longitudinal length.

15. An automotive door latch device according to claim 13, wherein said latch, said ratchet and said block lever are arranged in a front side of the latch body, said lock lever is arranged in a rear side of the latch body, and said block lever has a block pin which projects to the rear side of the latch body and is engageable with the lock lever.

16. An automotive door latch according to claim 13, wherein a straight line connecting said ratchet shaft and said latch shaft is arranged in such a manner as to be substantially in perpendicular to a horizontal passage for receiving the striker when the door moves toward the door-closed position from the door-open position.

17. An automotive door latch device according to claim 13, wherein said latch, said ratchet and said block lever are arranged in such a manner as not to substantially overlap with each other.

* * * * *